US009856594B2

(12) United States Patent
Davis

(10) Patent No.: US 9,856,594 B2
(45) **Date of Patent: *Jan. 2, 2018**

(54) WASHING MACHINE APPLIANCE AND SUSPENSION ASSEMBLY FOR SAME

(71) Applicant: General Electric Company, Schenectady, NY (US)

(72) Inventor: Paul Owen Davis, Prospect, KY (US)

(73) Assignee: Haler US Appliance Solutions, Inc., Wilmington, DE (US)

( * ) Notice: Subject to any disclaimer, the term of this patent is extended or adjusted under 35 U.S.C. 154(b) by 560 days.

This patent is subject to a terminal disclaimer.

(21) Appl. No.: 14/502,118

(22) Filed: Sep. 30, 2014

(65) Prior Publication Data

US 2016/0090679 A1 Mar. 31, 2016

(51) Int. Cl.
*D06F 37/26* (2006.01)
*D06F 37/20* (2006.01)
*D06F 37/24* (2006.01)

(52) U.S. Cl.
CPC ..... *D06F 37/268* (2013.01); *D06F 37/24* (2013.01)

(58) Field of Classification Search
CPC ..... D06F 37/24; D06F 37/268
See application file for complete search history.

(56) References Cited

U.S. PATENT DOCUMENTS 2,347,190 A * 4/1944 Geldhof ..... D06F 33/02 248/613
2,707,088 A * 4/1955 Shelton ..... D06F 37/24 248/569
2,987,190 A * 6/1961 Bochan ..... D06F 37/24 210/364
3,021,956 A * 2/1962 Bochan ..... D06F 37/24 210/364
4,174,622 A * 11/1979 Bunnell ..... D06F 37/24 248/568
6,065,170 A * 5/2000 Jang ..... D06F 37/203 68/12.04

(Continued)

FOREIGN PATENT DOCUMENTS

GB 583080 A 12/1946
JP 08-071290 3/1996

(Continued)

*Primary Examiner* — Michael Barr
*Assistant Examiner* — Benjamin L Osterhout
(74) *Attorney, Agent, or Firm* — Dority & Manning, P.A.

(57) ABSTRACT

Washing machine appliances and suspension assemblies for suspending tubs in washing machine appliances are provided. A suspension assembly includes a first pliable mount and a second pliable mount, the first pliable mount and second pliable mount spaced apart from each other along a lateral direction. The first and second pliable mounts each include a hollow body and a head, the head integral with the hollow body. The suspension assembly further includes a rocker arm engaging the head of the first pliable mount and the second pliable mount. The rocker arm extends between the first pliable mount and the second pliable mount along the lateral direction. The suspension assembly further includes a rod connected to the rocker arm and disposed between the first pliable mount and the second pliable mount along the lateral direction.

20 Claims, 7 Drawing Sheets

(56) References Cited

U.S. PATENT DOCUMENTS

| | | | | |
|---|---|---|---|---|
| 6,557,383 | B1 * | 5/2003 | Ito | D06F 37/04 68/140 |
| 2004/0016266 | A1 * | 1/2004 | Hisano | D06F 37/22 68/23.1 |
| 2006/0059960 | A1 | 3/2006 | Hansen | |
| 2006/0231725 | A1 * | 10/2006 | Rebolledo | F16F 1/128 248/638 |
| 2008/0229517 | A1 * | 9/2008 | Amarillas | D06F 35/005 8/159 |
| 2011/0247372 | A1 * | 10/2011 | Miller | D06F 37/12 68/13 R |
| 2012/0169194 | A1 * | 7/2012 | Maderic | D06F 37/20 312/228 |

FOREIGN PATENT DOCUMENTS

| | | | |
|---|---|---|---|
| JP | 08-164295 | | 6/1996 |
| JP | 3688896 | B2 | 1/2000 |
| KR | 2004 0092758 | A | 11/2004 |
| WO | WO 2013/002652 | | 1/2013 |

* cited by examiner

WASHING MACHINE APPLIANCE AND SUSPENSION ASSEMBLY FOR SAME

FIELD OF THE INVENTION

The present subject matter relates generally to washing machine appliances, such as vertical axis washing machine appliances, and suspension assemblies for washing machine appliances.

BACKGROUND OF THE INVENTION

Washing machine appliances generally include a cabinet which receives a tub for containing wash and rinse water. A wash basket is rotatably mounted within the wash tub. A drive assembly is coupled to the wash tub and configured to rotate the wash basket within the wash tub in order to cleanse articles within the wash basket. Upon completion of a wash cycle, a pump assembly can be used to rinse and drain soiled water to a draining system.

Washing machine appliances include vertical axis washing machine appliances and horizontal axis washing machine appliances, where "vertical axis" and "horizontal axis" refer to the axis of rotation of the wash basket within the wash tub. Vertical axis washing machine appliances typically have the wash tub suspended in the cabinet with suspension devices. The suspension devices generally allow the tub to move relative to the cabinet during operation of the washing machine appliance.

One issue with presently known suspension devices is the noise generated by such devices during washing machine appliance operation. For example, many presently known suspension devices utilize a ball and socket configuration, with the ball and socket formed from rigid materials. Relative motion between the components of such devices, wherein one component slides against another or separates from another, generates noise during operation, which can be undesirable to consumers. Additionally, the relative motion of the components can cause the components to wear at an undesirably quick rate. More recently, pliable materials have been utilized for various components of suspension devices, such as the balls. However, relative motion of the components and resulting noise is still an issue for many such devices.

Accordingly, improved suspension devices for washing machine appliances are desired in the art. In particular, suspension devices which provide reduced relative movement and noise generation would be advantageous.

BRIEF DESCRIPTION OF THE INVENTION

In accordance with one embodiment, a suspension assembly for suspending a tub in a washing machine appliance is provided. The suspension assembly includes a first pliable mount and a second pliable mount, the first pliable mount and second pliable mount spaced apart from each other along a lateral direction. The first and second pliable mounts each include a hollow body and a head, the head integral with the hollow body. The suspension assembly further includes a rocker arm engaging the head of the first pliable mount and the second pliable mount. The rocker arm extends between the first pliable mount and the second pliable mount along the lateral direction. The suspension assembly further includes a rod connected to the rocker arm and disposed between the first pliable mount and the second pliable mount along the lateral direction.

In accordance with another embodiment, a washing machine appliance is provided. The washing machine appliance includes a cabinet, and a tub disposed within the cabinet. The washing machine appliance further includes a plurality of suspension assemblies suspending the tub within the cabinet. Each of the plurality of suspension assemblies includes a first pliable mount and a second pliable mount, the first pliable mount and second pliable mount spaced apart from each other along a lateral direction. The first and second pliable mounts each include a hollow body and a head, the head integral with the hollow body. Each of the plurality of suspension assemblies further includes a rocker arm engaging the head of the first pliable mount and the second pliable mount. The rocker arm extends between the first pliable mount and the second pliable mount along the lateral direction. Each of the plurality of suspension assemblies further includes a rod connected to the rocker arm and disposed between the first pliable mount and the second pliable mount along the lateral direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
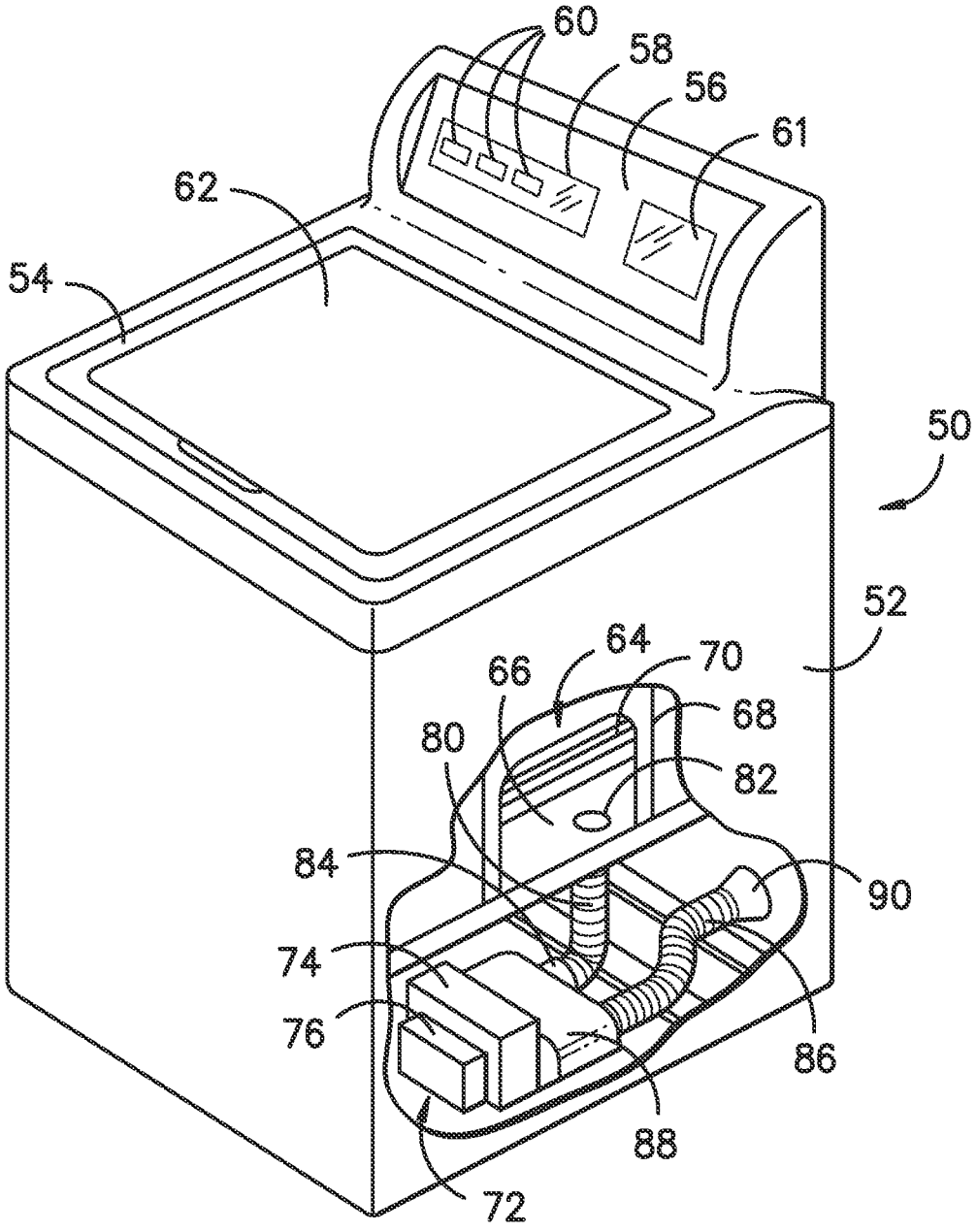
FIG. 1 provides a perspective view of a washing machine appliance, with a portion of a cabinet of the washing machine appliance shown broken away in order to reveal certain interior components of the washing machine appliance, in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view partially broken away of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming a sealed enclosure over wash tub 64.

As illustrated in FIG. 1, washing machine appliance 50 is a vertical axis washing machine appliance. While the present disclosure is discussed with reference to a vertical axis washing machine appliance, those of ordinary skill in the art, using the disclosures provided herein, should understand that the subject matter of the present disclosure is equally applicable to other washing machine appliances, such as horizontal axis washing machine appliances.

Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
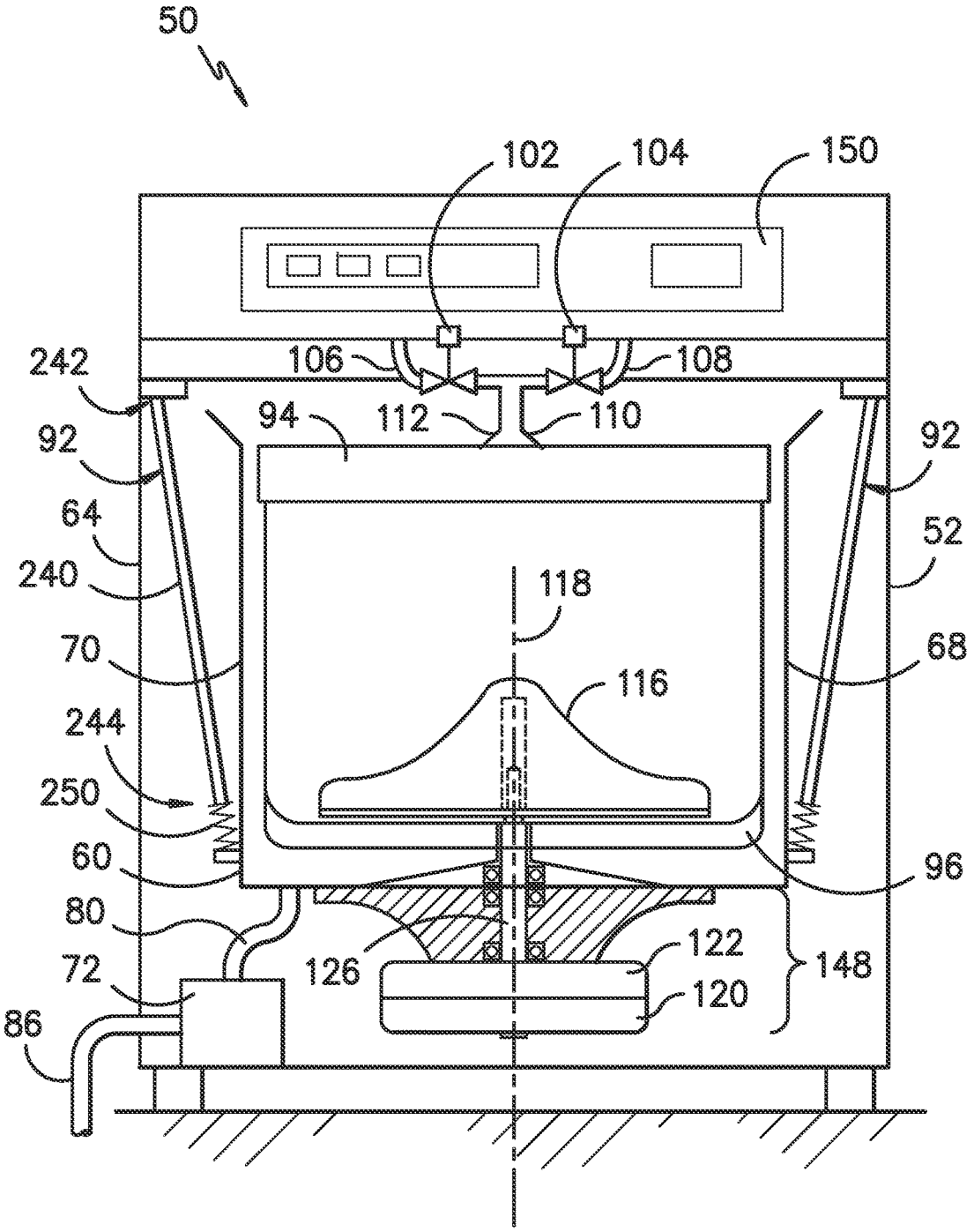
FIG. 2 provides a front elevation schematic view of various components of the washing machine appliance of FIG. 1.

FIG. 2 provides a front elevation schematic view of certain components washing machine appliance 50 including wash basket 70 movably disposed and rotatably mounted in wash tub 64 in a spaced apart relationship from tub side wall 68 and tub bottom 66. Basket 70 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine appliance 50 and, when connected to a building plumbing system (not shown), provide a fresh water supply for use in washing machine appliance 50. Liquid valves 102, 104 and liquid hoses 106, 108 are connected to a basket inlet tube 110, and fluid is dispersed from inlet tube 110 through a nozzle assembly 112 having a number of openings therein to direct washing liquid into basket 70 at a given trajectory and velocity. A dispenser (not shown in FIG. 2), may also be provided to produce a wash solution by mixing fresh water with a known detergent or other composition for cleansing of articles in basket 70.

An agitation element 116, such as a vane agitator, impeller, auger, or oscillatory basket mechanism, or some combination thereof is disposed in basket 70 to impart an oscillatory motion to articles and liquid in basket 70. In various exemplary embodiments, agitation element 116 may be a single action element (oscillatory only), double action (oscillatory movement at one end, single direction rotation at the other end) or triple action (oscillatory movement plus single direction rotation at one end, single direction rotation at the other end). As illustrated in FIG. 2, agitation element 116 is oriented to rotate about a vertical axis 118.

Basket 70 and agitator 116 are driven by a motor 120 through a transmission and clutch system 122. The motor 120 drives shaft 126 to rotate basket 70 within wash tub 64. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120 and transmission and clutch system 122 collectively are referred herein as a motor assembly 148.

Basket 70, tub 64, and machine drive system 148 are supported by a vibration dampening suspension system. The dampening suspension system can include one or more suspension assemblies 92, as discussed herein, coupled between and to the cabinet 52 and wash tub 64. Typically, four suspension assemblies 92 are utilized, and are spaced apart about the wash tub 64. For example, each suspension assembly 92 may be connected at one end proximate a corner of the cabinet 52 and at an opposite end to the wash tube 64. In particular, one end of each suspension assembly 92 may be connected to a corner bracket of the cabinet 52, as discussed herein. The dampening suspension system can include other elements, such as a balance ring 94 disposed around the upper circumferential surface of the wash basket 70. The balance ring 94 can be used to counterbalance an out of balance condition for the wash machine as the basket 70 rotates within the wash tub 64. The wash basket 70 could also include a balance ring 96 located at a lower circumferential surface of the wash basket 70.

A dampening suspension system generally operates to dampen dynamic motion as the wash basket 70 rotates within the wash basket 64. The dampening suspension system has various natural operating frequencies of the dynamic system. These natural operating frequencies are referred to as the modes of suspension for the washing machine. For instance, the first mode of suspension for the washing machine occurs when the dynamic system including the wash basket 70, tub 64, and dampening suspension system are operating at the first resonant or natural frequency of the dynamic system.

Operation of washing machine appliance 50 is controlled by a controller 150 which is operatively coupled to the user interface input located on washing machine backsplash 56 (shown in FIG. 1) for user manipulation to select washing machine cycles and features. In response to user manipulation of the user interface input, controller 150 operates the various components of washing machine appliance 50 to execute selected machine cycles and features.

In an illustrative embodiment, laundry items are loaded into basket 70, and washing operation is initiated through operator manipulation of control input selectors 60 (shown in FIG. 1). Tub 64 is filled with water and mixed with detergent to form a wash fluid, and basket 70 is agitated with agitation element 116 for cleansing of laundry items in basket 70. That is, agitation element is moved back and forth in an oscillatory back and forth motion. In the illustrated embodiment, agitation element 116 is rotated clockwise a specified amount about the vertical axis of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism. After the agitation phase of the wash cycle is completed, tub 64 is drained with pump assembly 72. Laundry items are then rinsed and portions of the cycle may be repeated, including the agitation phase, depending on the particulars of the wash cycle selected by a user.

Referring now to FIGS. 3 through 8, exemplary embodiments of a suspension assembly 92 in accordance with the present disclosure are shown. A suspension assembly 92 in accordance with the present disclosure generally includes a first pliable mount and a second pliable mount which are generally spaced apart from each other, and further includes a rocker arm extending between and engaging the first and second pliable mounts. A rod may be connected at one end to the rocker arm. The pliable mounts may be coupled to the cabinet 52 of the washing machine appliance 50, and the distal end of the rod may be coupled to the tub 64, thus suspending the tub 64 with relative to the cabinet 52. Suspension assemblies in accordance with the present disclosure advantageously provide reduced noise generation during operation, by reducing relative movement of the various components, such as relative movement of the rocker arm with respect to the first and second pliable mounts. The rocker arm instead may advantageously move as required due to tub movement, and the pliable mounts may deform as require to dampen and accommodate movement of the rocker arm that results from movement of the tub 64 during operation. In particular, the pliable mounts in accordance with the present disclosure may maintain contact with the rocker arm generally constantly during operation. Additionally, pliable mounts, rocker arms, and pockets in which the pliable mounts may be seated may advantageously be designed to provide progressive contact and thus support to each other when experiencing increased force during operation, and may further be designed to reduce stress concentrations during such progressive contact.

As discussed, a suspension assembly 92 in accordance with the present disclosure includes a first pliable mount 200 and a second pliable mount 202. The first and second pliable mounts 200, 202 are spaced apart from each other along a lateral direction L of the suspension assembly 92. First pliable mount 200 may include a hollow body 210 and a head 212, and second pliable mount 202 may similarly include a hollow body 214 and a head 216. The head 212, 216 of each pliable mount 200, 202 is integral with the respective hollow body 210, 214, such that each pliable mount 200, 202 is formed from a single, integral component. As shown, the hollow body 210, 214 of each mount 200, 202 may define an interior of the respective mount 200, 202. The head 212, 216, which may be above the hollow body 210, 214 of the respective mount 200, 202 along a vertical direction V of the suspension assembly 92, may be solid and thus not define an interior therein, or may optionally include define an interior.

In exemplary embodiments, the first pliable mount 200 and the second pliable mount 202 are each formed from an elastomer. For example, rubbers, including unsaturated and saturated rubbers, are particularly suitable for use in forming the first pliable mount 200 and the second pliable mount 202. Such materials advantageously provide the desired pliability which facilitates reduced noise and relative movement of the various suspension assembly 92 components.

Figure 6:
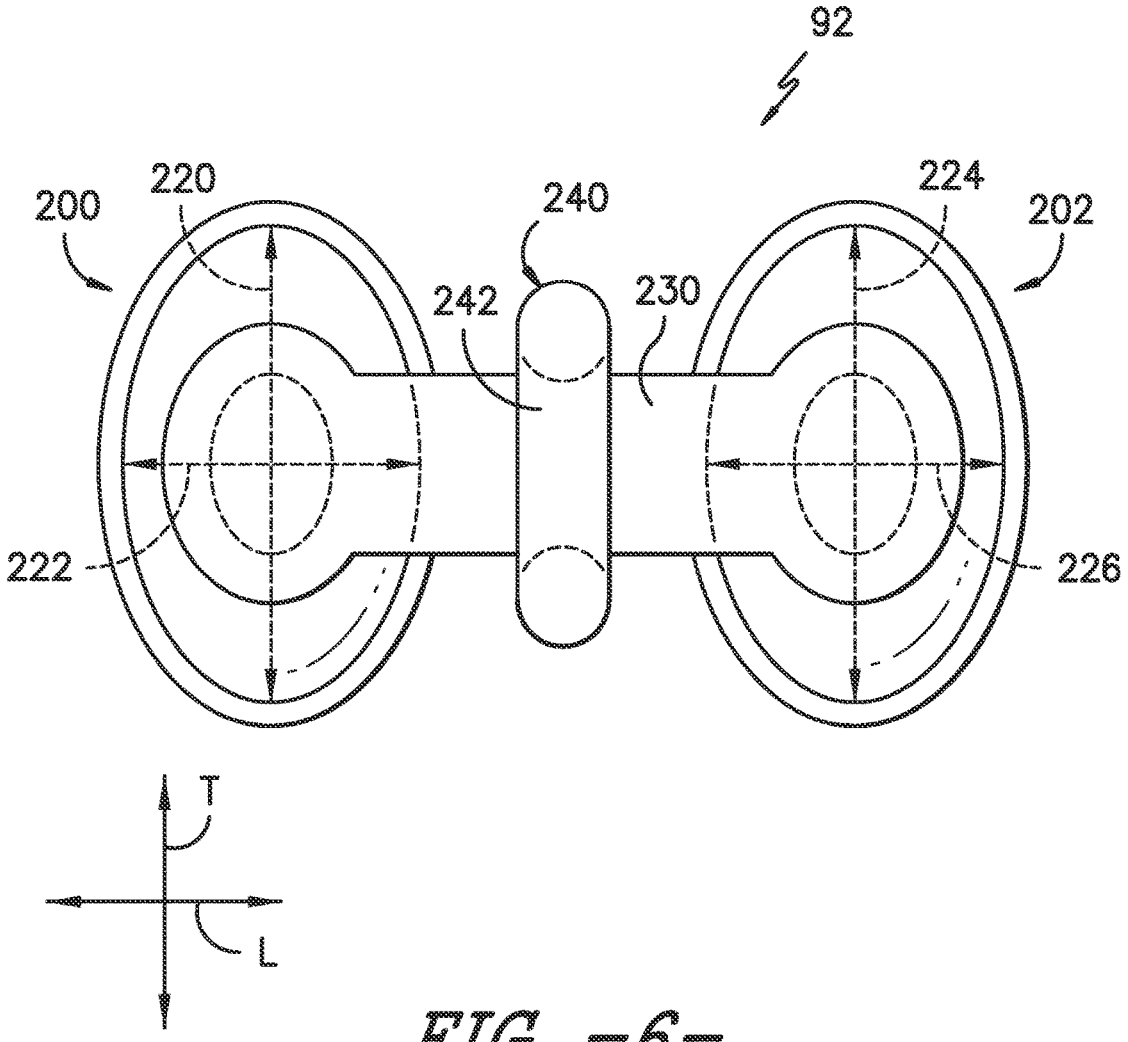
FIG. 6 is a top schematic view of components of a suspension assembly for a washing machine appliance in accordance with one embodiment of the present disclosure.

The shapes of the first and second pliable mounts 200, 202 may additionally advantageously facilitate reduced noise and relative movement. For example, as shown in FIG. 6, at least a portion of the hollow body 210 of the first pliable mount 200 and at least a portion of the hollow body 214 of the second pliable mount 202 each have an elliptical cross-sectional profile. Accordingly, hollow body 210, such as the profile thereof, may define a long axis 220 and a short axis 222 perpendicular to the long axis 220. Similarly, hollow body 212, such as the profile thereof, may define a long axis 224 and a short axis 226 perpendicular to the long axis 224. Further, in exemplary embodiments, the long axis 220, 224 of each elliptical cross-sectional profile of each respective hollow body 210, 214 may extending along a transverse direction T of the suspension assembly 92. Notably, the lateral, vertical and transverse directions T may be mutually perpendicular, defining an orthogonal coordinate system for the suspension assembly 92.

In alternative embodiments, the long axes 220, 224 may extend along the lateral direction L, or in any other suitable direction between and in the plan defined by the lateral direction L and the transverse direction T. In still other alternative embodiments, the hollow body 210 of the first pliable mount 200 and the hollow body 214 of the second pliable mount 202, or at least portions thereof, each have a circular cross-sectional profile or a cross-sectional profile having any suitable shape.

Further, as shown in FIGS. 3 through 8, at least a portion of the hollow body 210 of the first pliable mount 200 and at least a portion of the hollow body 214 of the second pliable mount 212 are tapered, such as in the vertical direction V. In exemplary embodiments, such taper is towards the head 212, 216 of the respective mount 200, 202. Accordingly, the mounts 200, 202, such as the hollow bodies 210, 214 thereof, may have approximately conical shapes. Notably, the tapering surfaces may be curvilinear as shown or linear.

As further illustrated, the heads 212, 216 may be generally smaller in profile than the respective hollow bodies 210, 214. Specifically, in exemplary embodiments as shown, a maximum cross-sectional profile area of the hollow body 210 of the first pliable mount 200 is greater than a maximum cross-sectional profile area of the head 212 of the first pliable mount 200. Similarly, a maximum cross-sectional profile area of the hollow body 214 of the second pliable mount 202 is greater than a maximum cross-sectional profile area of the head 216 of the second pliable mount 202.

As further illustrated in FIGS. 3 through 8, a rocker arm 230 may engage the heads 212, 216 of the pliable mounts 200, 202, and may further extend between the pliable mounts 200, 202 along the lateral direction L. Rocker arm 230 may generally be formed from a rigid material, such as in exemplary embodiments a fiber reinforced polymer. Engagement of the rocker arm 230 with the heads 212, 216 may advantageously allow the rocker arm 230 to move as required during operation of washing machine appliance 50, with no or reduced movement of the rocker arm 230 relative to the mounts 200, 202. Instead, the mounts 200, 202 deform and move with the rocker arm 230 to facilitate such rocker arm 230 movement.

In exemplary embodiments, rocker arm 230 includes a body 232 which defines a first socket 234 and a second socket 236. Each socket 234, 236 may define an interior, respectively. The first socket 234 and second socket 236 may be spaced apart from each other, such as along the lateral direction L when the rocker arm 230 is disposed on the mounts 200, 202. As shown, the first socket 234 may surround at least a portion of the head 212 of the first pliable mount 200, such that this portion of the head 212 is disposed within the interior thereof. Further, the second socket 236 may surround at least a portion of the head 216 of the second pliable mount 202, such that this portion of the head 216 is disposed within the interior thereof. In exemplary embodiments as shown, the head 212, 216 may fill a substantial portion of the respective interior and be in touch with inner surfaces 235, 237 of the respective socket 234, 236, thus reducing or eliminating movement of the socket 234, 236 relative to the respective head 212, 216.

As further illustrated, a damper assembly 92 in accordance with the present disclosure may include a rod 240, which may extend between a first end 242 and a second end 246. The rod 240 may be connected to the rocker arm 230, such as at the first end 242. For example, the first end 242 may be generally hook shaped, and may hang from the rocker arm 230, as illustrated. The rod 240 may be disposed between the first pliable mount 200 and the second pliable mount 202 along the lateral direction L, such that the rod 240 generally hangs between the mounts 200, 202 along the lateral direction L. In exemplary embodiments, the rod 240 is connected to the rocker arm 230 via a snap fit or light interference fit, although any suitable connection is within the scope and spirit of the present disclosure. In exemplary embodiments, the connection between the rod 240 and rocker arm 230 is a rigid connection, such that there is no relative movement between the rod 240 and rocker arm 230 when connected.

The rod 240 may further be connected at its second end 244 to the tub 64 or to another component of the suspension assembly 92 which is in turn connected to the tub 64. For example, referring briefly to FIG. 1, suspension assembly 92 may additionally include a spring 250 or other damping component which may be connected to and between the second end 244 and the tub 64.

Figure 4:
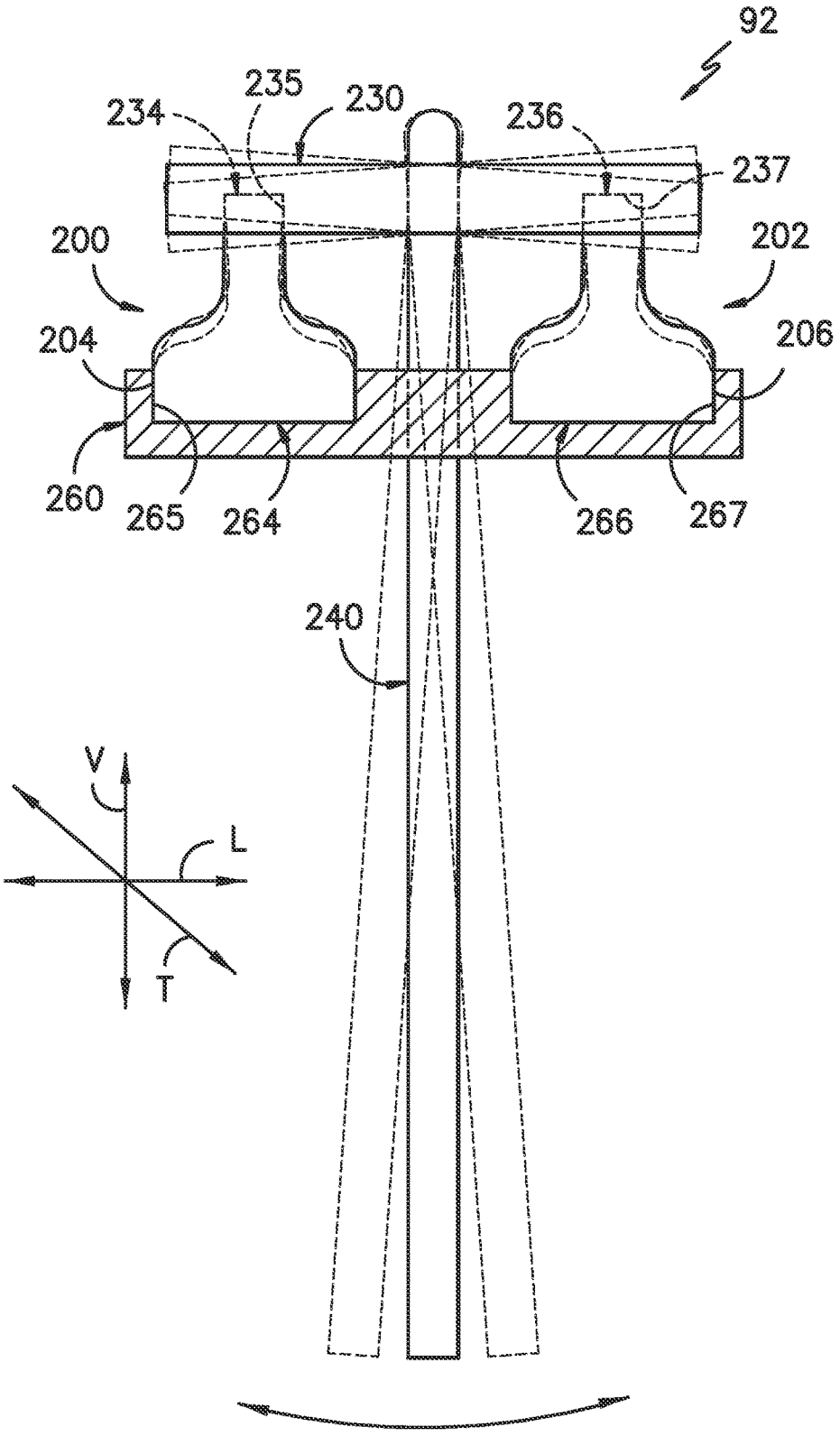
FIG. 4 is a front schematic view of components of a suspension assembly for a washing machine appliance in accordance with one embodiment of the present disclosure.
Figure 5:
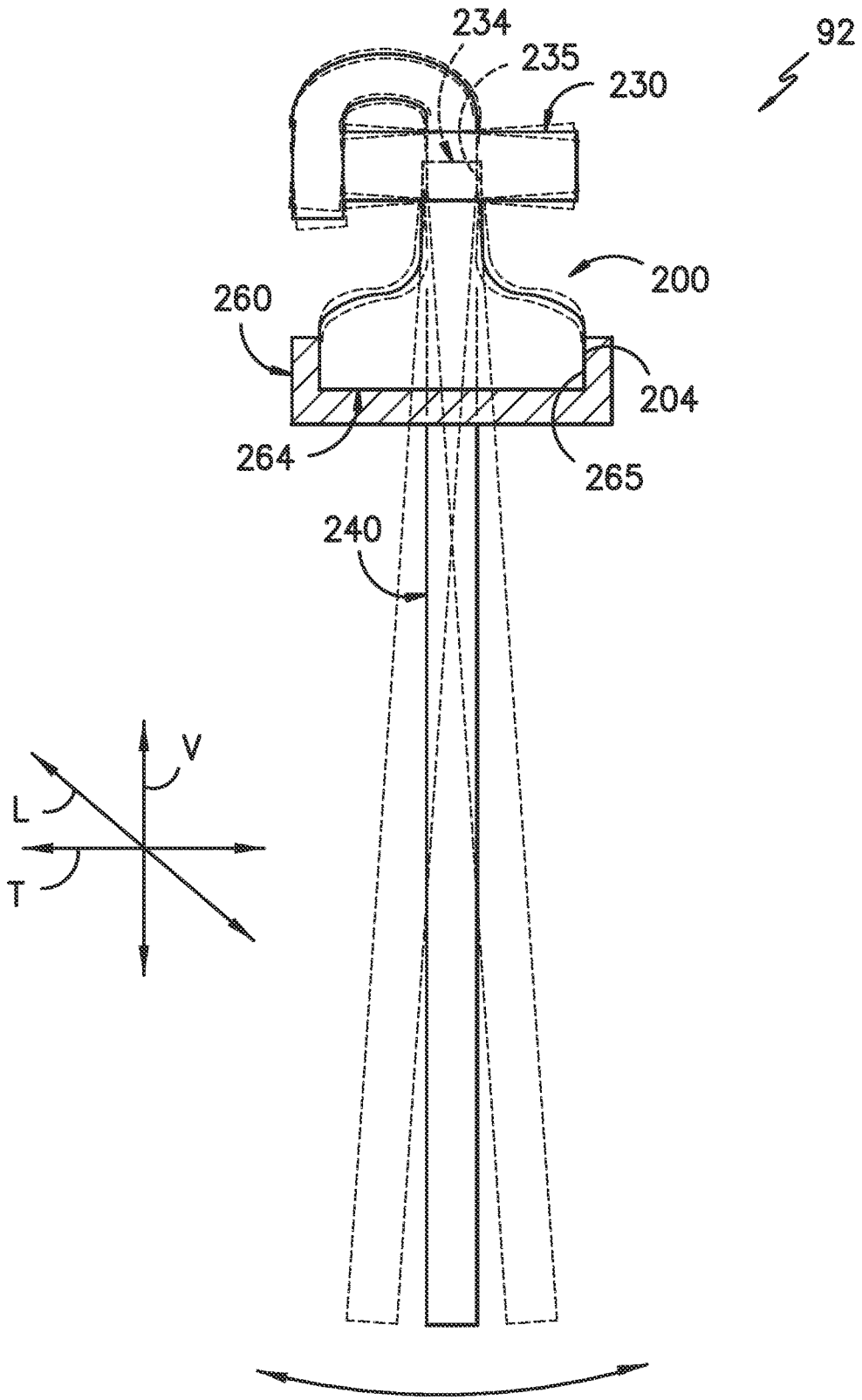
FIG. 5 is a side schematic view of components of a suspension assembly for a washing machine appliance in accordance with one embodiment of the present disclosure.

Movement of the rod 240, due to movement of the tub 64 during operation of the washing machine appliance 50, may thus cause movement of the rocker arm 230. For example, FIGS. 4 and 5 illustrate various movements of the rocker arm 230 caused by movement of the tub 64. In particular, due to the interaction between the rocker arm 230 and the mounts 200, 202, rocker arm 230 may pivot or rotate due to movement of the tub 64. FIG. 4 illustrates rotation about the transverse axis T of the rocker arm 230 and resulting deformation of the mounts 200, 202 that results such that movement of the rocker arm 230 relative to the mounts 200, 202 is reduced or eliminated. Specifically, relative movement between outer surfaces 204, 206 of the mounts 200, 202 and surfaces of the rocker arm 230 that the outer surfaces 204, 206 are in contact with, such as inner surfaces 235, 237 of sockets 234, 236 is reduced or eliminated. FIG. 5 illustrates rotation about the lateral axis L of the rocker arm 230 and resulting deformation of the mounts 200, 202 that results such that movement of the rocker arm 230 relative to the mounts 200, 202 is reduced or eliminated. Specifically, relative movement between outer surfaces 204, 206 of the mounts 200, 202 and surfaces of the rocker arm 230 that the outer surfaces 204, 206 are in contact with, such as inner surfaces 235, 237 of pockets 234, 236 is reduced or eliminated.

Figure 7:
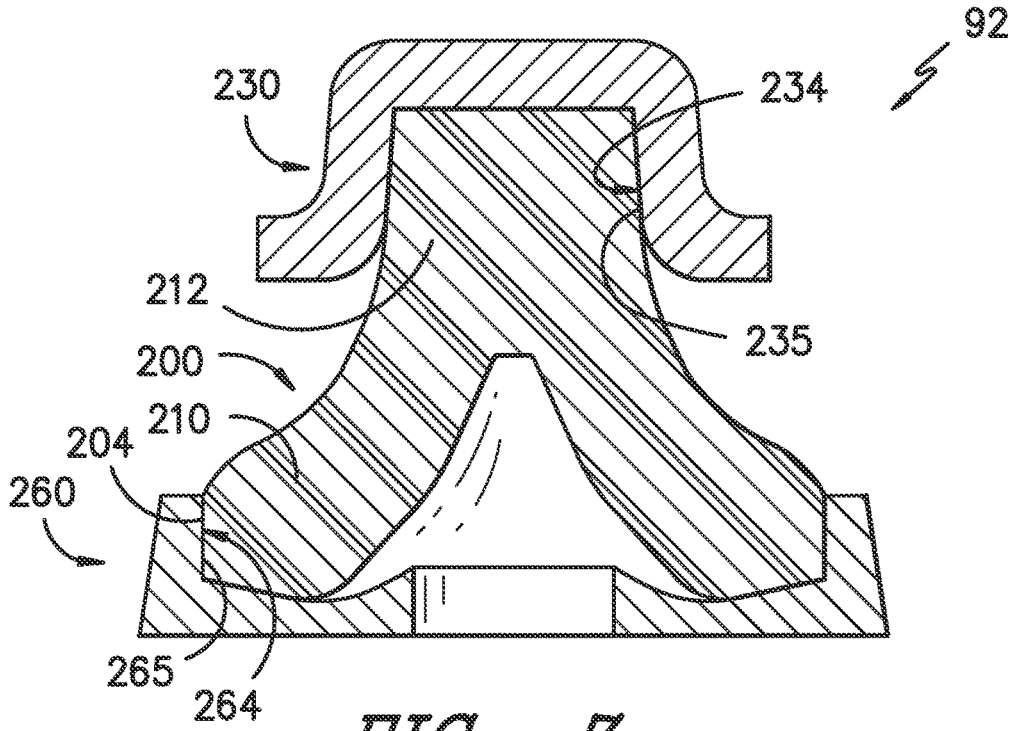
FIG. 7 is a cross-sectional view of components of a suspension assembly for a washing machine appliance in an unloaded position in accordance with one embodiment of the present disclosure.
Figure 8:
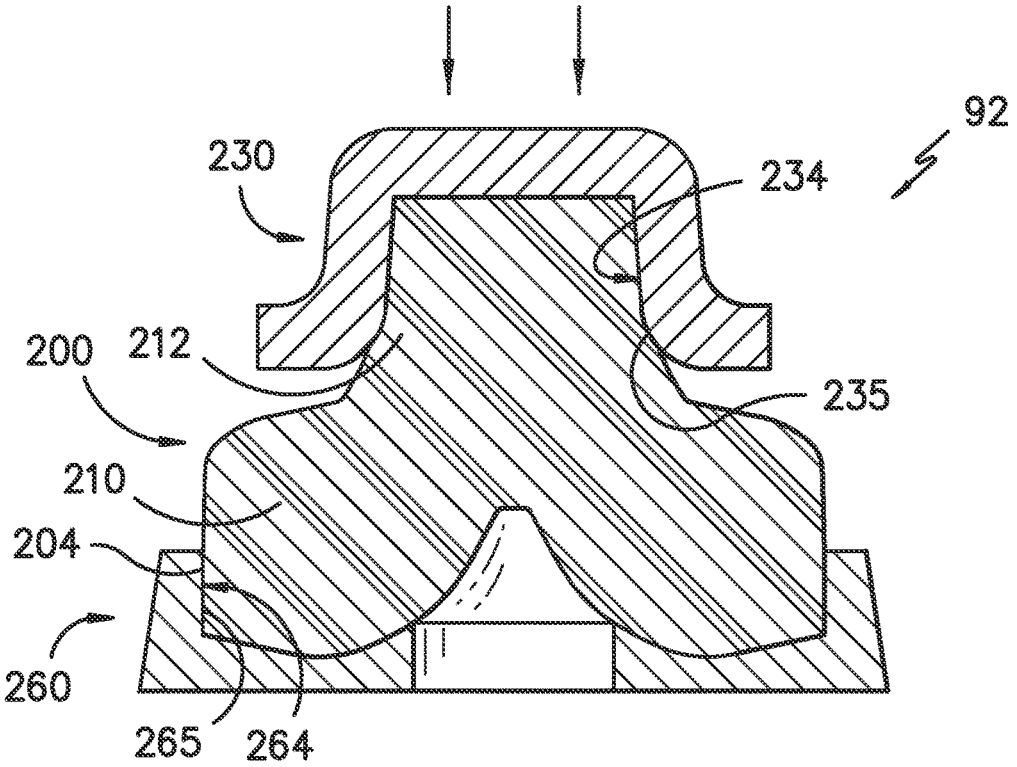
FIG. 8 is a cross-sectional view of components of a suspension assembly for a washing machine appliance in a loaded position in accordance with one embodiment of the present disclosure.

FIGS. 7 and 8 further illustrate the relationship between the rocker arm 230 and the mounts 200, 202 during operation of the washing machine appliance 50. Only mount 200 is illustrated in FIGS. 7 and 8, but it should be understood that such disclosure applies equally to mount 202. FIG. 7 illustrates mount 200 seated in first pocket 264 and engaged with first socket 234 in an unloaded position. FIG. 8 illustrates mount 200 seated in first pocket 264 and engaged with first socket 234 in a loaded position. The pliable nature of the mounts 200, 202, which thus reduces or eliminates respective movement of the various components of the assembly 92, is thus illustrated by FIGS. 7 and 8 as well as FIGS. 4 and 5.

Figure 3:
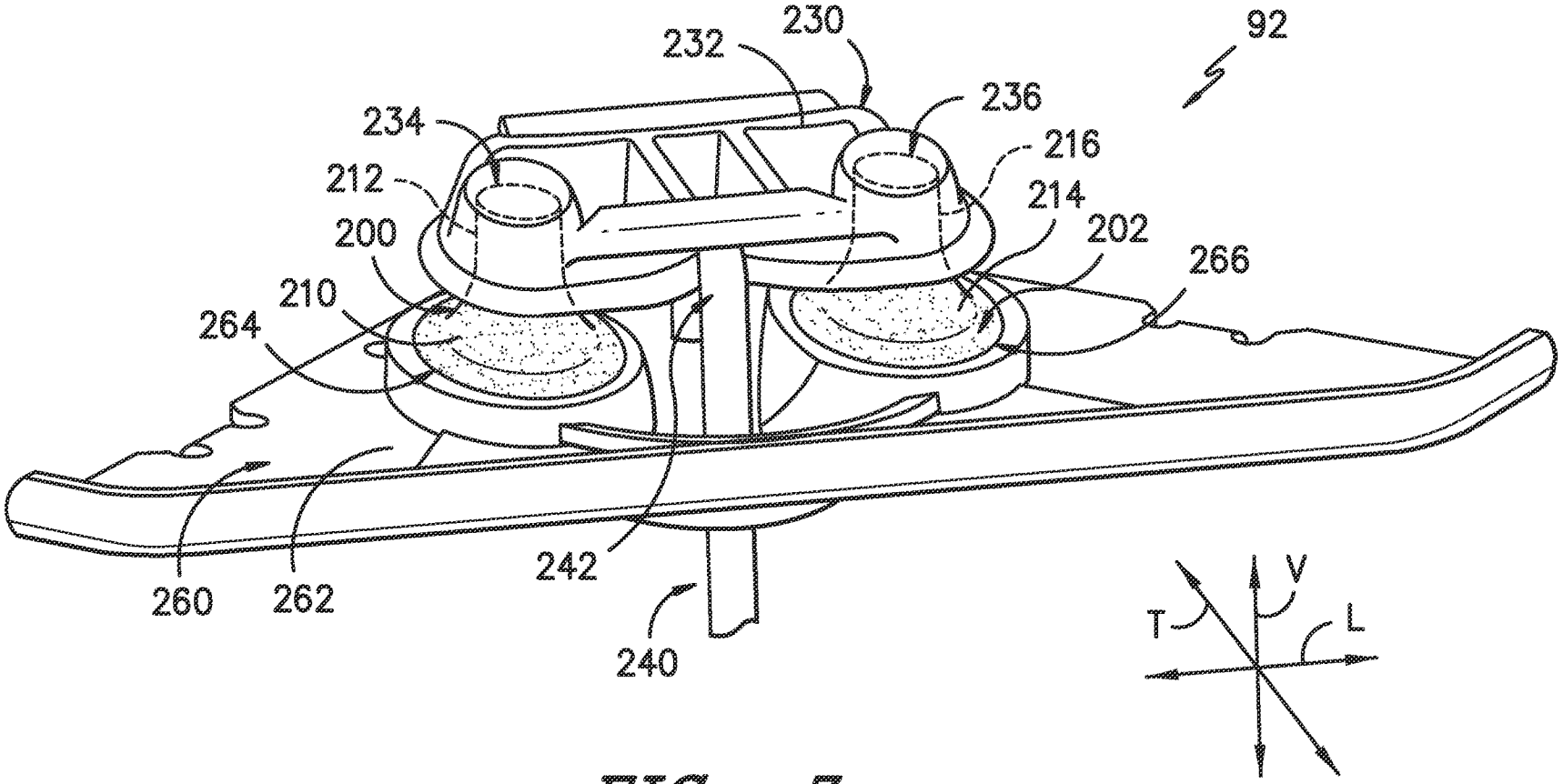
FIG. 3 is a perspective view of components of a suspension assembly for a washing machine appliance in accordance with one embodiment of the present disclosure.

Suspension assemblies 92 in accordance with the present disclosure may further include a frame 260. The first pliable mount 200 and the second pliable mount 202 may be seated on the frame 260. In exemplary embodiments, as shown in FIG. 3, frame 260 may be a corner bracket of the cabinet 52 of the washing machine appliance 50, and the frame 260 may thus connect the suspension assembly 92 to the cabinet 52. Alternatively, the frame 260 may be component that is separate from the corner bracket, and which may connect to the corner bracket or otherwise connect to the cabinet 52.

In exemplary embodiments as illustrated, frame 260 may include a body 262, which may define a first pocket 264 and a second pocket 266. Each pocket 264, 266 may define an interior, respectively, which may be defined by inner surfaces 265, 267, respectively. The first pocket 264 and second pocket 266 may be spaced apart from each other, such as along the lateral direction L when the first pliable mount 200 and the second pliable mount 202 are seated on the frame 260. As shown, the first pocket 264 may surround at least a portion of the hollow body 210 of the first pliable mount 200, such that this portion of the hollow body 210 is disposed within the interior thereof. Further, the second pocket 266 may surround at least a portion of the hollow body 214 of the second pliable mount 202, such that this portion of the hollow body 214 is disposed within the interior thereof. In exemplary embodiments as shown, the hollow body 210, 214 may fill a substantial portion of the respective interior and be in touch with inner surface 265, 267 of the respective pocket 264, 266, thus reducing or eliminating movement of the hollow body 210, 214 with respect to the respective pocket 264, 266. Specifically, during operation, the area of contact between the outer surfaces 204, 206 of the mounts 200, 202 and the inner surface 265, 267 of the pockets 264, 266 may progressively increase as the load carried by the mounts 200, 202 increases (and vice versa), thus reducing or eliminating relative movement between these surfaces. Such progressive increase and decrease in the area of contact between these surfaces advantageously reduces or eliminates the formation of large stress gradients in the mounts 200, 202, thereby reducing accumulated damage to the mounts 200, 202 due to repeated load cycles.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A suspension assembly for suspending a tub in a washing machine appliance, the suspension assembly comprising:

a first pliable mount and a second pliable mount, the first pliable mount and second pliable mount spaced apart from each other along a lateral direction, the first and second pliable mounts each comprising a hollow body and a head, the head integral with the hollow body;

a rocker arm engaging the head of the first pliable mount and the second pliable mount, the rocker arm extending between the first pliable mount and the second pliable mount along the lateral direction; and a rod connected to the rocker arm and disposed between the first pliable mount and the second pliable mount along the lateral direction.

2. The suspension assembly of claim 1, wherein the first pliable mount and the second pliable mount are each formed from an elastomer.

3. The suspension assembly of claim 2, wherein the elastomer is a rubber.

4. The suspension assembly of claim 1, wherein the rocker arm comprises a body, the body defining a first socket and a second socket, the first socket and second socket spaced apart from each other, the first socket surrounding at least a portion of the head of the first pliable mount and the second socket surrounding at least a portion of the head of the second pliable mount.

5. The suspension assembly of claim 1, wherein at least a portion of the hollow body of the first pliable mount and at least a portion of the hollow body of the second pliable mount each have an elliptical cross-sectional profile.

6. The suspension assembly of claim 5, wherein a long axis of each elliptical cross-sectional profile extends along a transverse direction.

7. The suspension assembly of claim 1, wherein at least a portion of the hollow body of the first pliable mount and at least a portion of the hollow body of the second pliable mount are tapered.

8. The suspension assembly of claim 1, wherein a maximum cross-sectional profile area of the hollow body of the first pliable mount is greater than a maximum cross-sectional profile area of the head of the first pliable mount, and a maximum cross-sectional profile area of the hollow body of the second pliable mount is greater than a maximum cross-sectional profile area of the head of the second pliable mount.

9. The suspension assembly of claim 1, further comprising a frame, the first pliable mount and the second pliable mount seated on the frame.

10. The suspension assembly of claim 9, wherein the frame comprises a body, the body defining a first pocket and a second pocket, the first pocket and second pocket spaced apart from each other, the first pocket surrounding at least a portion of the hollow body of the first pliable mount and the second pocket surrounding at least a portion of the hollow body of the second pliable mount.

11. A washing machine appliance, the washing machine appliance comprising:

a cabinet;

a tub disposed within the cabinet; and a plurality of suspension assemblies suspending the tub within the cabinet, each of the plurality of suspension assemblies comprising:

a first pliable mount and a second pliable mount, the first pliable mount and second pliable mount spaced apart from each other along a lateral direction, the first and second pliable mounts each comprising a hollow body and a head, the head integral with the hollow body;

a rocker arm engaging the head of the first pliable mount and the second pliable mount, the rocker arm extending between the first pliable mount and the second pliable mount along the lateral direction; and a rod connected to the rocker arm and disposed between the first pliable mount and the second pliable mount along the lateral direction.

12. The washing machine appliance of claim 11, wherein the first pliable mount and the second pliable mount are each formed from an elastomer.

13. The washing machine appliance of claim 12, wherein the elastomer is a rubber.

14. The washing machine appliance of claim 11, wherein the rocker arm comprises a body, the body defining a first socket and a second socket, the first socket and second socket spaced apart from each other, the first socket surrounding at least a portion of the head of the first pliable mount and the second socket surrounding at least a portion of the head of the second pliable mount.

15. The washing machine appliance of claim 11, wherein at least a portion of the hollow body of the first pliable mount and at least a portion of the hollow body of the second pliable mount each have an elliptical cross-sectional profile.

16. The washing machine appliance of claim 15, wherein a long axis of each elliptical cross-sectional profile extends along a transverse direction.

17. The washing machine appliance of claim 11, wherein at least a portion of the hollow body of the first pliable mount and at least a portion of the hollow body of the second pliable mount are tapered.

18. The washing machine appliance of claim 11, wherein a maximum cross-sectional profile area of the hollow body of the first pliable mount is greater than a maximum cross-sectional profile area of the head of the first pliable mount, and a maximum cross-sectional profile area of the hollow body of the second pliable mount is greater than a maximum cross-sectional profile area of the head of the second pliable mount.

19. The washing machine appliance of claim 11, further comprising a frame, the first pliable mount and the second pliable mount seated on the frame.

20. The washing machine appliance of claim 19, wherein the frame comprises a body, the body defining a first pocket and a second pocket, the first pocket and second pocket spaced apart from each other, the first pocket surrounding at least a portion of the hollow body of the first pliable mount and the second socket surrounding at least a portion of the hollow body of the second pliable mount.

* * * * *